United States Patent [19]

Durst et al.

[11] Patent Number: 5,030,955

[45] Date of Patent: Jul. 9, 1991

[54] REMOTE CONTROL TRANSMITTER

[75] Inventors: Klaus Durst, Bruchsal; Richard Kramer, Eisingen, both of Fed. Rep. of Germany

[73] Assignee: Nokia Unterhaltungselektronik, Pforzheim, Fed. Rep. of Germany

[21] Appl. No.: 550,647

[22] Filed: Jul. 10, 1990

[30] Foreign Application Priority Data

Jul. 25, 1989 [DE] Fed. Rep. of Germany ..... 3924551

[51] Int. Cl.[5] ..... G08C 19/12; H01H 35/02

[52] U.S. Cl. ..... 341/176; 200/DIG. 29; 200/61.47; 250/222.1; 331/65

[58] Field of Search ..... 341/176; 340/689, 555; 455/100; 33/366; 331/65; 200/61.47, 61.52, DIG. 29; 250/222.1

[56] References Cited

U.S. PATENT DOCUMENTS 4,216,467 8/1980 Colston ..... 341/176 X
4,565,999 1/1986 King et al. ..... 340/706
4,745,402 5/1988 Auerbach ..... 340/709
4,829,285 5/1989 Brand et al. ..... 340/689 X
4,977,404 12/1990 Durst et al. ..... 341/176

*Primary Examiner*—Glen R. Swann, III
*Assistant Examiner*—Thomas J. Mullen, Jr.
*Attorney, Agent, or Firm*—Peter C. Van Der Sluys

[57] ABSTRACT

A remote control transmitter includes a function selector device (17) for outputting selection signals in dependence on a function selected by operating the device. A function is selected by tilting the function selector device which includes optically functioning tilt switches. For this purpose, a ball guide housing (50) is constructed with five ball resting places, i.e. places in which a ball (K) within each specified tilt range always adopts a stable position. At one of the ball resting places a light transmitter (D) is mounted, while at other ball resting places light receivers (P1–P3) are located. A multi-bit signal is outputted by the light receivers, with the different bit sequences corresponding to different selection signals.

10 Claims, 6 Drawing Sheets

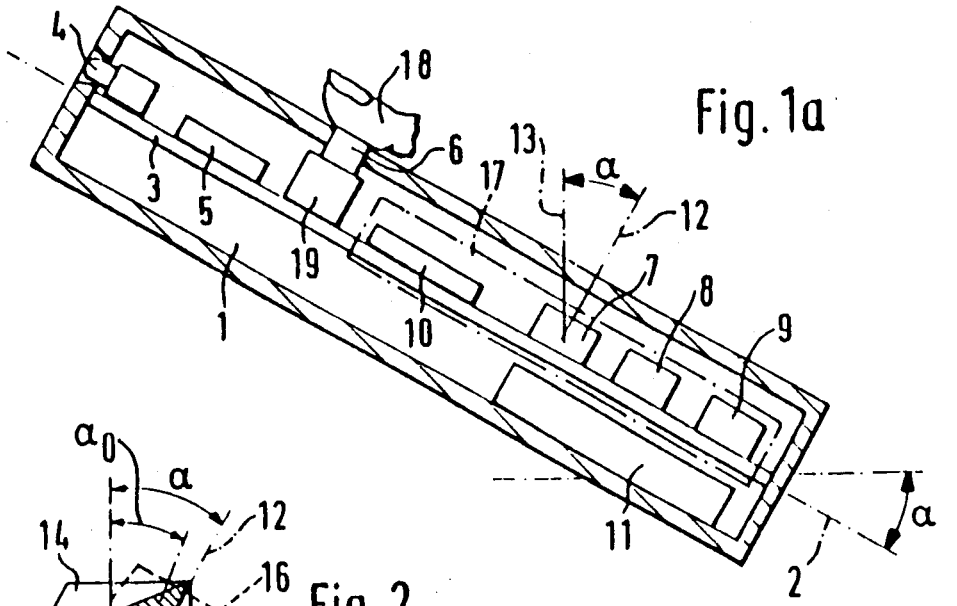
Fig. 1a
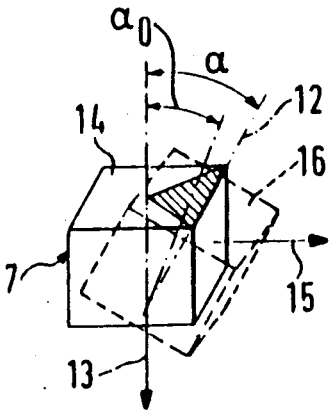
Fig. 2
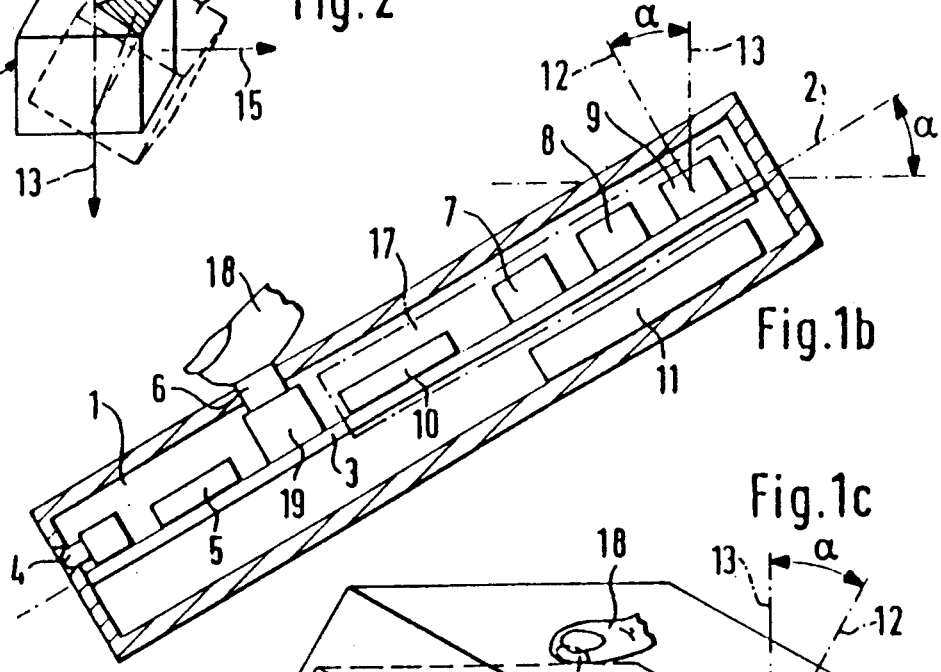
Fig. 1b
Fig. 1c
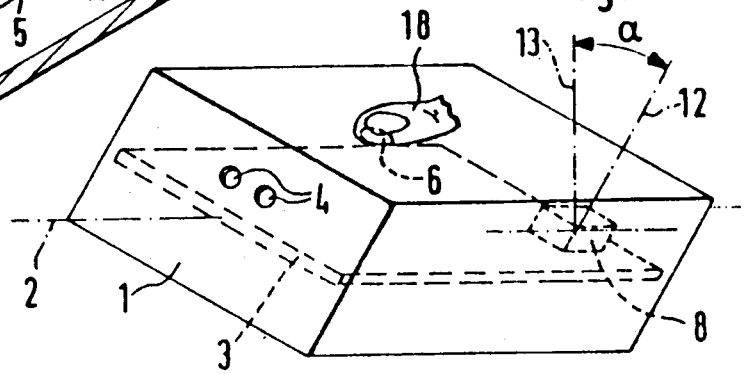

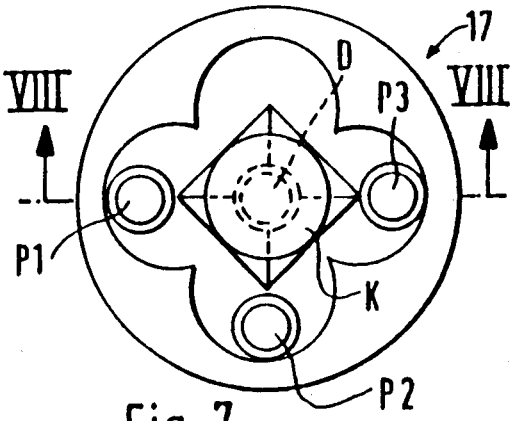
Fig. 7
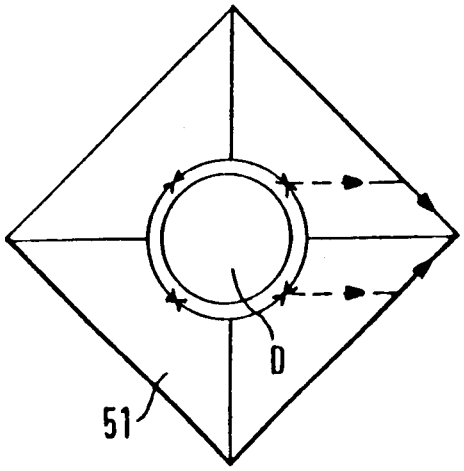
Fig. 9
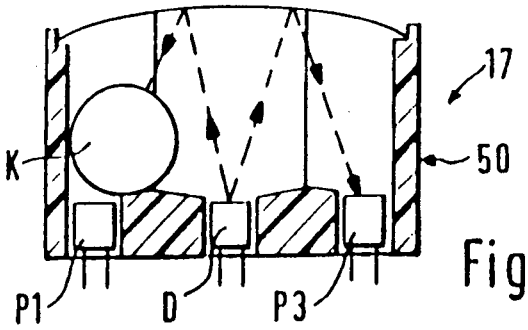
Fig. 8
Fig. 10
| TILT | BALL POSITION | P1. | P2 | P3 |
|---|---|---|---|---|
| HORIZ. | | 0 | 0 | 0 |
| LEFT | | 0 | 1 | 1 |
| RIGHT | | 1 | 1 | 0 |
| UP | | 1 | 0 | 1 |
| DOWN | | 1 | 1 | 1 |

REMOTE CONTROL TRANSMITTER

BACKGROUND OF THE INVENTION

1. Technical Area

The invention relates to a remote control transmitter of the type used in particular for controlling devices of entertainment electronics over a wireless link, e.g. for controlling television sets, video recorders, audio sets, slide or film projectors.

2. Description of the Prior Art

The state of the art will be explained on the basis of the following example. Assume that on the screen of a television set a cursor is to be moved up and down in a vertical direction and to and from in a horizontal direction. Remote control transmitters of the conventional types exhibit as a function selector device for triggering such movements four buttons, of which each serves to trigger one of the cursor movements mentioned. A fifth button may be provided, which when pressed moves the cursor back to its original position generally at the top left of the screen. The four or five buttons represent a function selector device which outputs selection signals to a transmission circuit, depending on the function selected by pressing one of the buttons. Depending on the function selected, the transmission circuit passes coded transmission signals to a transmission element configuration located at a side of the housing. This side with the transmission element configuration is in the remarks below referred to as the front of the housing. The transmission element configuration radiates in a preferred direction, coinciding with a direction of the housing which in the following remarks will be referred to as the longitudinal direction of the housing. The coded signals are received by the device being operated, and in accordance with the code received the selected function is executed e.g. a cursor is moved in the desired direction.

A significantly more user-friendly alternative to the familiar remote control transmitters mentioned above are remote control transmitters of the type introduced in the past few years which are constructed so that to select a function the transmitter must be moved in a certain way; for example, the housing must be tilted upwards with its longitudinal axis if a cursor is to be moved upwards, or be tilted downwards with its longitudinal axis if the cursor is to be moved downwards, or the longitudinal axis must be turned to the left or right in the horizontal plane around a vertical axis in order to trigger a movement of the cursor to the left or right respectively. In this case no button need be pressed in order to perform function selection. A remote control transmitter of this type is described, for example, in U.S. Pat. No. 4,565,999. A similar remote control transmitter, which however still exhibits a trigger button (which triggers the transmission mode of the transmitter only when it is pressed in order to reduce the drain on the transmitter battery) is known from U.S. Pat. No. 4,745,402.

The volume of stereo loudspeakers, for example, can be adjusted in a corresponding way. If the volume of the left-hand loudspeaker is to be increased, the remote control transmitter is directed not centrally to the associated control unit but turned to the left in the horizontal plane, in imitation of a human being pointing to the left-hand loudspeaker. If then a trigger button is pressed, the volume is increased for as long as the button is depressed. If the button is released and then pressed again, the volume is lowered once more. If the volume of the right-hand loudspeaker is to be altered, the remote control transmitter is correspondingly swivelled to the right in the horizontal plane, with reference to the direct direction to the control unit. Thus by turning the remote control transmitter to and from the loudspeaker in question can be selected and by pressing the trigger button the user can switch over between lowering and increasing the volume.

Remote control transmitters permitting the simple mode of operation described above, where it is not necessary to press different buttons in order to select different functions, are relatively complex in construction, since they have to generate a radiation field rather precisely defined in directional terms and which additionally must be received in directionally selective mode by a receiver on the control unit being operated. The problem presenting itself was accordingly to indicate a remote control transmitter which is simple in construction and does not require a directionally selective receiver to receive its signals.

SUMMARY OF THE INVENTION

The remote control transmitter described in this invention exhibits a tilt switch device which is so located in the housing and so constructed that depending on the tilt of the housing it emits not less than four different selection signals, namely:

- a first selection signal when the housing is tilted forwards,
- a second selection signal when the housing is tilted backwards,
- a third selection signal when the housing is tilted to the left around its longitudinal axis, and
- a fourth selection signal when the housing is tilted to the right around its longitudinal axis.

Preferably another fifth, selection signal is emitted, namely in cases when the housing is in an essentially horizontal position.

In order to process the selection signals thus generated, the remote control transmitter exhibits a conventional transmission circuit, which supplies coded transmission signals to a conventional transmission element configuration.

The remote control transmitter in accordance with the invention utilizes an insight into the causal relationships of different spatial movements, namely that a movement of an obJect to the left, for example, can be performed not only by a linear shift of the object to the left, but also by rolling the object to the left. This leads to the insight that swivelling a guide beam to the left and turning the guide beam around its longitudinal axis to the left are synonymous movements. If in accordance with the example above a cursor is to be moved to the left in a horizontal place, the correspondingly directly associated movement of a remote control transmitter is that of swivelling the transmitter to the left in a horizontal plane. However, taking into account the spatial relationship detailed above, a tilting movement of the remote control transmitter around its longitudinal axis to the left is an indirectly associated movement.

The conventional remote control transmitters utilize the direct relationship between movement of cursor and remote control transmitter, i.e. swivel the remote control transmitter horizontally to the left, for example, when a cursor movement horizontally to the left is desired. The remote control transmitter in accordance with the invention, on the other hand, utilizes for the above-mentioned case the indirect relationship already described, namely tilting the remote control transmitter around its longitudinal axis to the left, when a cursor movement horizontally to the left is desired.

The replacement of the direct relationships hitherto utilized by the indirect relationships described enables a remote control transmitter to be enormously simplified in technical terms. For now it is merely necessary to ascertain in what direction the remote control transmitter is tilted. This can be easily implemented using simple tilt switches, different types of which are already known. It is accordingly no longer necessary to emit radiation with an extremely precise directional characteristic, and to provide directionally selective reception of this radiation; on the contrary, the radiation can be transmitted and received in any way desired, with the only necessity being to ensure that it is received at all.

In the dependent claims, preferred embodiment forms of tilt switch devices are given. Particular operational reliability is provided by an optical device with a ball, which in dependence on the tilt of the housing in each case goes to one of five stable positions, in which the ball is retained until the tilt is again altered to such an extent that the current ball retention place is left and a new one is reached. Not less than three of the ball retention places feature a light receiver, which does not receive any radiation when the ball is in the ball retention place concerned. Preferably a light transmitter is located in one of the ball retention places, and one light receiver in each of the three others. But the light transmitter can also be in a separate location, and light receivers located in not less than four ball retention places.

The use of the remote control transmitter in accordance with the invention is not restricted to moving a cursor. This example served only as an illustration. As mentioned at the beginning, the remote control transmitter in question is one which can be used for any remote control jobs. Depending on the tilt set at any one time, an associated coded signal is emitted, and an associated function corresponding to the code involved is triggered at the unit being controlled.

DESCRIPTION OF THE DRAWINGS

FIGS. 1*a* and 1*b* schematic longitudinal sections through an operated remote control transmitter in upwards and downwards-tilted positions respectively;

FIG. 1*c* schematic perspective view of a remote control transmitter in a left-tilted position;

FIG. 2 schematic perspective view of a tilt switch in two different positions;

FIGS. 7 and 8 plan view onto and cross-section through a function selector device with optically functioning tilt switches;

FIG. 9 plan view onto a detail of the function selector device in accordance with FIGS. 7 and 8, to illustrate the rolling track of a ball;

FIG. 10 table to illustrate different control states of the function selector device in accordance with FIGS. 7 and 8;

DETAILED DESCRIPTION OF THE PREFERRED EMBODIMENT

Figure 3:
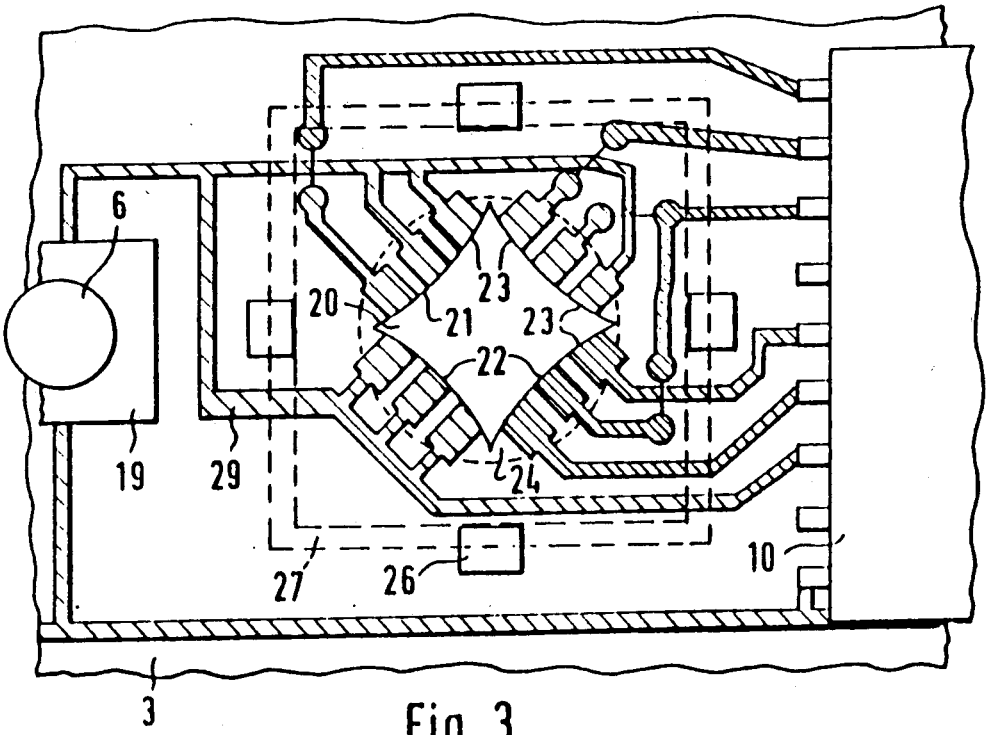
FIG. 3 plan view onto a section of a circuit board of a remote control transmitter of a ball-switched function selector device.

FIGS. 1*a* and 1*b* show a schematic representation of the side view of a remote control transmitter which in the case of FIG. 1*a* is tilted upwards with its front by a tilt angle (a) from its horizontal position, and in the case of FIG. 1*b* is tilted downwards from its horizontal position by the tilt angle (a). The transmitter housing (1) is along a vertical plane through the longitudinal axis (2) of the remote control transmitter drawn in cut-open form so that the essential components of the remote control transmitter can be shown schematically. On a board (3) linked immovably to the transmitter housing, are located transmission elements (4), a transmitter (5), a pushbutton (6), several tilt switches (7, 8, 9), which form a function selector device (17), and an evaluation circuit (10). The transmitter (5) and the evaluation circuit (10) together form a transmission circuit. For power supply, the remote control transmitter contains a battery (11).

The tilt switches (7, 8 and 9) exhibit a rest position, which applies when their main axis (12) lies parallel to the gravitational direction (13). If one of the tilt switches, e.g the tilt switch (7), is tilted out of its rest position (14) in a certain direction (15) into a position (16), which is inclined at an angle (a) to the rest position (14) and whose tilt angle (a) is greater than a trigger angle ($a_O$), as shown schematically in FIG. 2, then this tilt switch generates an output signal. If more than one of these tilt switches (7, 8, 9) are located on the board (3) of the remote control transmitter in such a way that their lines of action (15) point in different directions, then a function selector device (17) constructed with such switches can identify through its output signals a tilt of the remote control transmitter out of its horizontal position, which is the reference operating position of the remote control transmitter in regard to all tilt movements for controlling a remotely controlled electrical device. From the output signals generated by the tilt switches of the remote control transmitter, the evaluation circuit (10) forms signals which are converted by the transmitter (5) into coded transmission signals for the transmission elements (4).

For remote control of an electrical device, the user of the remote control transmitter holds it in his or her hand in such a way that with the thumb (18) of this hand he or she can operate the pushbutton (6) of an on-off switch (19) of the remote control transmitter protruding out of the transmitter housing (1). When this pushbutton (6) is pressed, the function selector device (17) of the remote control transmitter is switched on, so that it can detect a tilt position of the hand-held remote control transmitter caused by a swivel movement of the user's hand, and can form a control command therefrom. When the remote control transmitter is tilted around the longitudinal axis (2) to the left, the position of the housing shown in FIG. 1c is reached. In this figure, the board (3) surrounded by the transmitter housing (1) of the remote control transmitter is shown as a broken line, and the tilt switch (8) located on this board is shown, which is operative in the lateral tilt away from the horizontal of the transmitter housing as shown in FIG. 1c, and in the event of tilt angle (a) being greater than the trigger angle ($a_O$) generates an output signal.

If when the pushbutton (6) is pressed an output signal is generated at none of the tilt switches (7, 8 9) of the remote control transmitter, then the transmission circuit (10, 5) concludes herefrom that the remote control transmitter is located in the reference operating position, i.e. in horizontal position, and generates an output signal assigned to the rest position of the remote control transmitter, which is likewise used as a control command, and results in a signal being transmitted to the remotely controlled device. To represent the four tilt directions (front of the transmitter housing tilted upwards or downwards, or transmitter housing turned around the longitudinal axis (2) to the right or to the left), the function selector device (17) of the remote control transmitter shown in FIGS. 1a to 1c contains 4 tilt switches, of which three are schematically represented with the reference identifications (7, 8 and 9). In another embodiment example, the function selector device (17) contains a fifth tilt switch which in the case of a position where the angular deviation of the longitudinal axis (2) of the tilt switch from the gravitational direction (13) is less than the trigger angle ($a_O$) of the other four tilt switches, generates independently of direction an output signal and thus identifies a position around the rest position of the remote control transmitter.

In another embodiment example the elements detecting the tilt of the remote control transmitter against a reference operating position of the remote control transmitter are direction-dependent sensors, which detect the angle deviating from the gravitational direction, and generate an electrical output signal depending on the amount of angular deviation.

Figure 4A:
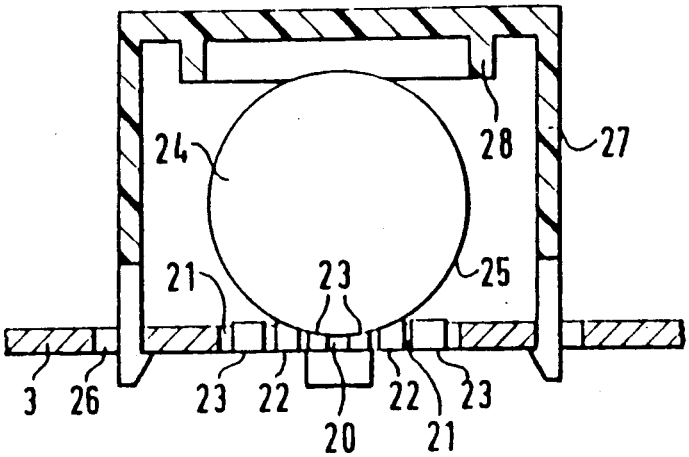
FIGS. 4*a* and 4*b* cross-sections of the function selector device in accordance with FIG. 3 in the case of horizontal and upwards-tilted positions of the circuit board respectively.
Figure 4B:
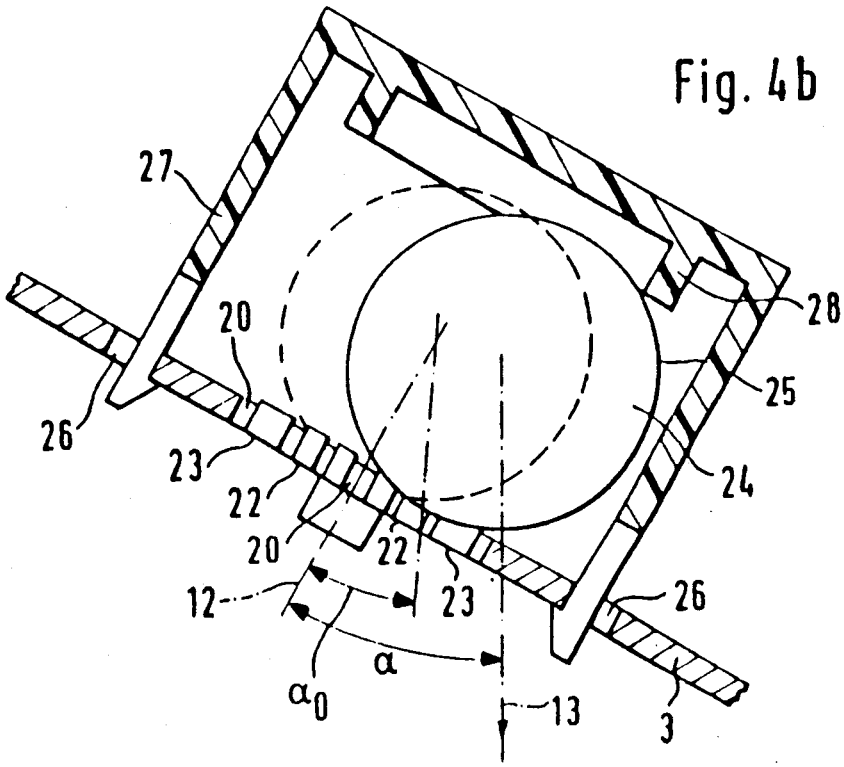

In the following drawings (FIGS. 3-6), some embodiment examples of a function selector device (17) of remote control transmitters with tilt switches are illustrated in more detail. In the case of the embodiment example shown in FIGS. 3, 4a and 4b, FIG. 3 shows a section of a circuit board (3) in place of the function selector device (17) of a remote control transmitter. The circuit board (3) contains at this point an axisymmetrical recess (20), whose edges (21) are slightly curved into the recess (20). At the middle of each edge, a narrower contact element (22) and to the right and left of this a wider contact element (23) are fitted. In the horizontal board, a ball (24), represented in the drawing by a broken line, is fitted. The surface (25) of the ball is highly electrically conductive (FIGS. 4a and 4b) and in this position rests on the middle contact elements (22) of the edges (21) in the recess (20), thus providing an electrical connection between the middle contact elements (22). The ball (24) thus forms together with the middle contact elements (22) a tilt switch for identifying a more or less horizontal rest position of the remote control transmitter. The four corners of the square recess (20) of the circuit board (3) point in the four directions in which the other four tilt switches become operative. The contact elements (23) at the corners of each pair of meeting edges (21) of the recess form together with the ball (24) in each case another tilt switch, whose contact elements are not electrically connected by the ball in the rest position of the remote control transmitter. Not until the remote control transmitter is tilted in one of the directions in which the corners of the recess (20) point and in which the centre of gravity of the ball (24) passes through the vertical plane through the contact points of the ball at edge (21) of the recess (20) will the ball roll along the two edges (21) which form the tip in the direction of tilt of the remote control transmitter, as far as a stopper-limited position in which the ball connects the two contact elements (23) lying closest to the tip. A position of this type is shown in FIG. 4b for an upward tilt of the remote control transmitter.

To protect the ball (24) and to limit its travel on the edges (21) of the recess (20), a cover cap (27) is attached in recesses (26) of the board (3); this cap is shown as a broken line in FIG. 3 and in a cut-open side view in FIGS. 4a and 4b. The cap (27) contains a stopper edge (28), which limits the travel of the ball (24) and guides it when required. The curved construction of the edges (21) of the recess (20) also contributes to better guidance of the ball (24) in the individual lines of action. The one contacts of the five tilt switches are in the embodiment example shown connected jointly via electric wires (29) to the on-off switch (19) of the remote control transmitter; the other contact elements of these tilt switches are individually connected to an evaluation circuit (10).

In FIG. 4a, a side view agains shows the position of the ball (24), which is the common switching element of the function selector device (17) formed out of the five tilt switches, in the horizontal rest position of the remote control transmitter, in which the main axis (12) of the switch configuration shown runs parallel to the gravitational direction (13). In FIG. 4b, the switch configuration shown in FIG. 4a is shown in a position of the remote control transmitter upwards-tilted by the angle (a), a position in which the ball (24) is lying against the stopper (28) of the cover cap (27). The tilt angle (a) is greater than the trigger angle ($a_O$) in which the centre of gravity of the ball (24) just passes through the vertical plane through the contact points of the ball on the edges (21) of the recess (20) in the board (3).

Figure 5:
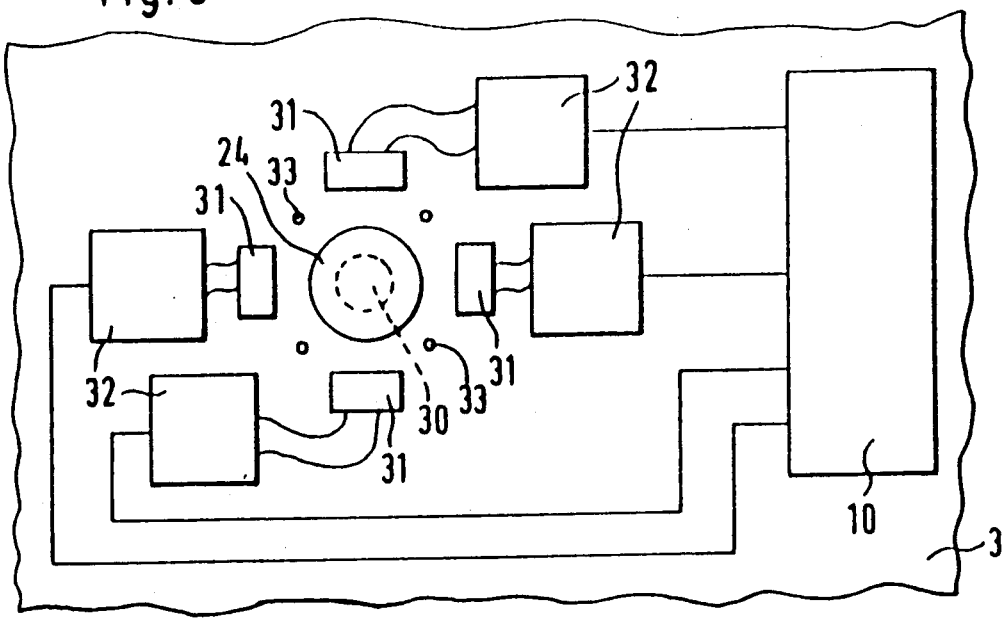
FIG. 5 plan view onto a schematically drawn function selector device with dampable oscillators as tilt switches.

The section of a circuit board (3) of a remote control transmitter as shown in FIG. 5 contains a function selector device (17) in which likewise a ball (24) is fitted in a recess (30) of the circuit board. In the drawing, the circular recess (30) is covered by the ball (24) and shown as a broken line. Around the ball (24), on the circuit board (3), four oscillator coils (31) are located in a collar configuration, i.e. looking at the opened transmitter housing one oscillator coil in front of and behind, and one oscillator coil to the right and the left next to the recess (30) in the circuit board (3) of the remote control transmitter. Each of these oscillator coils (31) is connected to an associated electric oscillator (32). The oscillators (32) are adjusted so that in the rest position of the ball (24), in which it is fitted in the recess (30), they generate an electrical oscillation. However, as soon as the ball approaches one of the oscillator coils, and due to a tilt of the transmitter housing is touching it, the oscillation will cease. Guide rods (33) located on the circuit board ensure that the ball (24) approaches only one oscillator coil when the remote control transmitter is moved, so that the oscillation of only one oscillator is interrupted. The oscillators (32) are connected to an evaluation circuit (10), which generates a selection signal for transmitter (5) dependent on the tilt position of the remote control transmitter, for transmitting a coded signal to a remotely controlled electrical device. The ball (24) and the oscillator coils (31) are protected and safeguarded by a cover cap not shown in the drawing.

Figure 6:
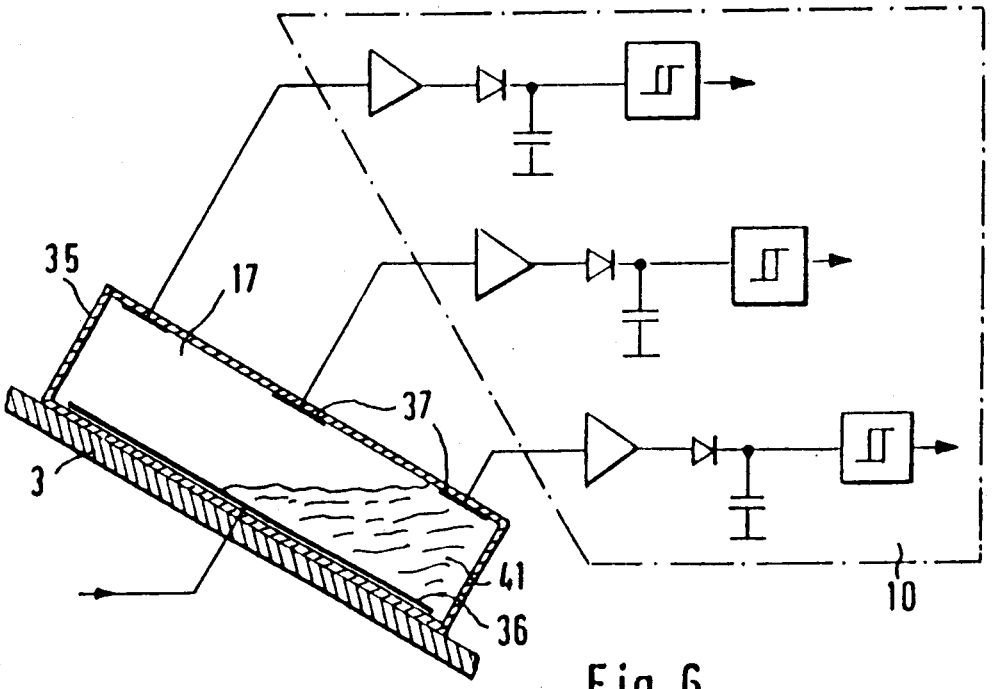
FIG. 6 schematic cross-section through a function selector device with liquid tilt switches with associated evaluation circuit.

FIG. 6 shows a diagram of a liquid-type function selector device (17). This device is located on the circuit board (3) mounted in a stable position on the (not shown in detail) transmitter housing of a remote control transmitter, and contains at the bottom of its leakproof housing (35) a large-area, plate-shaped middle contact (36). At the cover wall of the switch housing (35) opposite the bottom, arranged in a collar configuration distributed around the edge, there are four contact elements (37) of a significantly smaller area. The switch housing contains a non-wetting, electrically conductive liquid (41), in a quantity ensuring that in a vertical position of the circuit board (3) it covers only one of the contact elements (37). From a certain tilt of the circuit board (3) away from the horizontal, corresponding to a trigger angle ($a_O$), the conductive liquid wets the contact element (37) assigned to the direction of tilt of the circuit board (3) and thus to the direction of tilt of the remote control transmitter, thus establishing a conductive connection between the middle contact (36) and this contact element (37), so that the tilt switch thus formed is conductively closed. The four contact elements (37) of the liquid-type function selector device (17), of which the drawing shows only three, are connected to an evaluation circuit (10), which from the signals transmitted over the contacts forms a direction-dependent output signal, which is converted by the transmitter (5) into a coded transmission signal and then transmitted. As the conductive, non-wetting liquid (41) in the switch housing (35), mercury is especially suitable, since due to its inertia and heaviness it exhibits a high flow-damping effect. If a less viscous liquid is used then the switch housing (35) will contain an appropriate flow-damping agent.

FIGS. 7-12 relate to the preferred embodiment form of a function selector device (17). This consists of a ball guide housing (50), a ball (K), a light-emitting photodiode (D) and three photosensitive phototransistors (P1-P3). The ball guide housing (50) consists of a cylindrical wall made of plastic, a plastic bottom, and a metal lid. The photodiode (D) and the phototransistors (P1-P3) are fitted in the bottom of the housing.

As can be seen from the plan view in FIG. 7, the ball guide housing (50) is divided up into four quadrants located symmetrically in relation to the central axis. In the bottom, there is a recess in the middle and in three of the four quadrants. In the middle recess is the photodiode (D), while in the quadrant recesses are the phototransistors (P1-P3). In each of the four quadrants, the inside wall of the housing is in part-cylindrical construction, with a cylinder radius essentially corresponding to the ball radius. This design serves to guide and hold the ball in different positions. This purpose is also served by a pyramid-shaped indentation (51), which is orientated so that its tip points downwards into the centre of the middle recess, and its four base corners point towards the four quadrants. The base line of the pyramid is more or less equal to the ball diameter. The inclination of the side surfaces of the pyramid in conjunction with the diameter of the middle recess and the ball diameter determine the tip-out angle. As already mentioned, the stoppers at the quadrants are constructed in part-cylindrical shape, with approximately the radius of the ball, thus ensuring that this latter is reliably captured and fixed in position. The inwardly-projecting tips between the quadrant part-cylinders guide the ball (K) positively into the nearest quadrant, since the tips, in conjunction with the plane side surfaces of the pyramid, do not permit any stable intermediate position. It is thus possible to move the ball (K) from one quadrant directly into an adjoining one, without it having to run through the middle position for this purpose.

The movement of the ball (K) will now be explained in more detail, with reference to FIG. 9. The starting point is the stable middle position, i.e. the position which is assumed when the remote control transmitter is horizontal. In this middle position, the ball possesses four contact points at the pyramid surfaces (marked by crosses). The inclination of the surfaces is designed to ensure that the rolling track after out-tipping of the ball exhibits a slight gradient towards a quadrant, so that the ball is accelerated in that direction. FIG. 9 illustrates a rolling movement towards the right. At first the ball, when the tip-out angle has been exceeded rolls along the edge of the pyramid on initially parallel rolling tracks on the surfaces, then proceeds on the base edges of the pyramid (which meet at right angles to each other). At the transition from the parallel rolling tracks to the base edges, the gradient effectively increases, thus producing a kink in the track gradient. Before these edges meet in the corner, the contact surface of a quadrant has been reached.

When the function selector device is swivelled back, the kink in the gradient delays the return movement of the ball until the rolling track again possesses sufficient gradient towards the centre in order to accelerate the ball (K) in that direction. This ensures that the ball can adopt only 5 stable rest positions, which in the remarks below are referred to as ball resting places. Due to the design of the connecting paths, it is impossible for the ball to come to a standstill on them, thus ensuring unambiguous switching performance.

When the ball (K) is located in the middle position, as shown in FIG. 7, none of the phototransistors (PI - P3) is receiving light, so that each of them outputs a logic "0" signal, as listed in the first line of the table in FIG. 10. If the ball is moved to the left, in accordance with the position shown in FIG. 8 (actually for the position of the ball in FIG. 8 the ball guide housing would have to be tilted a little to the left, but this has not been done, in order to make clearer the relationship with the plan view in accordance with FIG. 7), the phototransistor (P1) is covered, and it will accordingly emit the signal "0", whereas the phototransistors (P2 and P3) are receiving light and are therefore each supplying the signal "1". The left-hand position is accordingly identified by the three-bit signal "011". This three-bit signal is a selection signal outputted by the function selector device (17), which indicates that the function to be selected is that which is assigned to the left-tilted position of the remote control transmitter. The other three-bit selection signals for the other possible stable positions of the ball are listed in FIG. 10.

Figure 11:
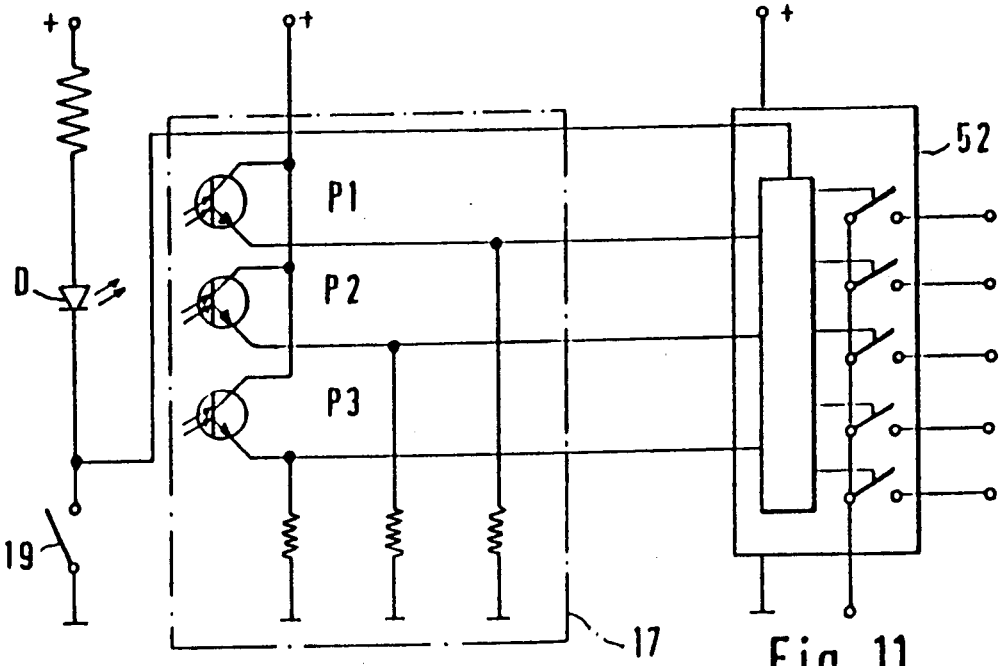
FIG. 11 diagram of the function selector device in accordance with FIGS. 7 and 8 with associated evaluation circuit.
Figure 12:
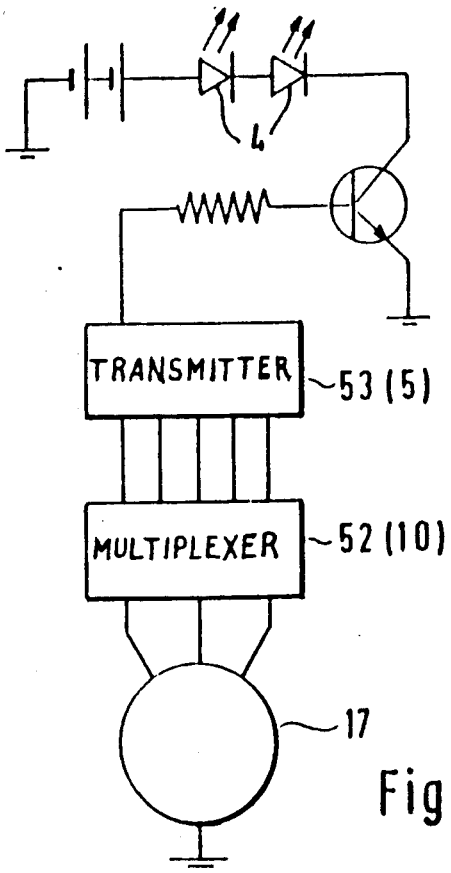
FIG. 12 diagram of a remote control transmitter with a function selector device in accordance with FIGS. 7 and 8.

The photodiode (D) can emit light continuously, but it is of advantage when the remote control transmitter exhibits an on-off switch (19) as shown in FIG. 1. The diode is in this case activated only when the switch (19) is operated. A corresponding circuitry for the function selector device is shown in FIG. 11. As can be seen from this drawing, the photodiode (D) is connected in series with the on-off switch (19), so that it is only supplied with voltage when the switch is closed. Closing the switch also causes activation of a decoder in an analog multiplexer (52), which converts the current three-bit selection signal from the function selector device (17) into one of five signals, which are passed on over an appropriately assigned line to an IR transmitter IC 53. This ensures that a transmission signal is differently coded in each case, depending on which of the five lines has been used to feed in a signal.

The coded transmission signal is used to control the transmission elements (4) via a driver circuit.

In the case of the preferred embodiment example, the photodiode (D) was an IR diode of the CQY 36 N type, the phototransistors (P1–P3) were of the BPW 17 N type, the analog multiplexer (52) was of the 4051 type, and the IR transmitter IC 53 of the SAA 1250 type. IR diodes were used as the transmission elements (4), as is customary for this purpose. The two diodes were arranged so that one of them emitted when tilted upwards against the longitudinal axis (2) and the other when tilted downwards. The tilt angle corresponded to that which was also necessary in order to move the ball (K) from the middle ball resting place into one of the outer ones, namely approx. 20°.

It is pointed out that the configuration of the photoactive elements in a function selector device with tilt switches with optical evaluation can also be done differently than explained with reference to FIGS. 7–10. For example, the photodiode (D) can be located at any of the four ball resting places shown. The three other ball resting places are then occupied by phototransistors. Or four of the five ball resting places can be occupied by phototransistors; in this case, a redundant signal is obtained. In all cases where the light-emitting photodiode is located in the bottom of the ball guide housing (50) it is of advantage when the lid of the housing is in reflecting design. This is not necessary in cases where the photodiode is located at the lid, and radiates downwards. In this case, a phototransistor can be located in the bottom at each ball resting place. Nor is an analog multiplexer required in this case in order to decode a multi-bit signal in order to determine the current position of the ball; but the indication of a phototransistor that it is not receiving any light is then a direct sign that the ball is located in the associated ball resting place.

It has been described above how a switching hysteresis is achieved with the aid of the pyramid-shaped impression (51) in the bottom of the ball guide housing (50). A corresponding hysteresis can, however, also be achieved by means of a different construction of the ball guide tracks between the ball resting places. There are numerous mechanical construction options for this purpose.

The transmission elements (4) need not necessarily be light-emitting elements, or especially IR elements, but can also be quite different transmission elements, in particular ultrasonic transmission elements.

The ball (K) can be made of any desired material, provided it is sufficiently smooth and heavy to ensure defined rolling characteristics. The reflection behaviour for light of the wavelength used is not significant. The material of the ball guide housing (50) must be as opaque as possible for the light wavelength used, and as impervious as possible to outside light. The photosensitive elements must be arranged so that they are covered as effectively as possible by the ball when this is located in the ball resting place concerned. With the pattern illustrated in FIGS. 7–12, over 40 dB level difference between Light and Dark were achieved, thus enabling logic modules to be reliably controlled. After deducting the possible scattering of approx. 15 dB, there still remains a signal change of over 25 dB between Light and Dark. The functional reliability is thus considerably higher than when using tilt switches where contacts are closed mechanically, e.g. by a resting ball. In addition, a function selector device with optical tilt switches is considerably more environmentally compatible than are conventional tilt switches with mercury.

What is claimed is:

1. Remote control transmitter comprising
a housing (1),
a function selector device (17) for outputting selection signals in dependence on a function selected by operating the function selector device,
a transmission circuit (5, 10; 52, 53) for outputting coded transmission signals, whose coding depends on the selection signal of the selected function, and
a transmission element configuration (4) at the front of the housing, which receives the coded transmission signals from the transmission circuit, for transmitting coded signals,
characterized in that
the function selector device is a tilt switch device (17), which is so located in the housing (1) and so constructed that depending on the tilt of the housing it emits not less than four different selection signals, namely:
a first selection signal when the housing is tilted forwards,
a second selection signal when the housing is tilted backwards,
a third selection signal when the housing is tilted to the left around its longitudinal axis, and
a fourth selection signal when the housing is tilted to the right around its longitudinal axis.

2. Remote control transmitter in accordance with claim 1, characterized in that the tilt switch device (17) is so located in the housing (1) and so constructed that it outputs a fifth selection signal when the housing is in an essentially horizontal position.

3. Remote control transmitter in accordance with claim 1, characterized in that the function selector device (17) contains several tilt switches (7, 8, 9) assigned to different tilt directions, which generate an output signal only in the case of an angular position deviation in the direction to which each is assigned.

4. Remote control transmitter in accordance with claim 1, characterized in that the tilt switches are contact elements (22, 23), which are located on a board (3) linked in a stable position to the transmitter housing (1), and in the event of an angular deviation (a) of the transmitter housing from a horizontal reference position said contact elements are electrically connected directly or indirectly by a heavy body (24) which is moved out of its rest position by the alteration in angular position.

5. Remote control transmitter in accordance with claim 4, characterized in that the tilt switches are configured as part of an electrical oscillator (32), whose oscillator coils (31) are located on a board (3) linked in a stable position to the transmitter housing (1), and that not less than one heavy body (24) coupled with the transmitter housing is provided, which in the event of an angular deviation (a) of the transmitter housing from a horizontal reference position moves out of a rest position towards an oscillator coil, and interrupts the oscillator oscillation by damping the oscillator coil.

6. Remote control transmitter in accordance with claim 4, characterized in that the heavy body is a ball (24) highly electrically conductive on its surface (25), which in the horizontal position of the housing (1) is located in a recess (20, 30) of the board (3).

7. Remote control transmitter in accordance with claim 1, characterized in that the tilt switches are liquid switches which are located on a board (3) linked in a stable position to the transmitter housing (1), wherein at a certain tilt (a) of the transmitter housing the liquid provides an electrically conductive link between contacts.

8. Remote control transmitter in accordance with claim 1, wherein the tilt switch device comprises, a ball guide housing (50) with five ball resting places, with the ball resting places being so located that four of them surround a central ball resting place in one place in a quadrant configuration, the ball resting places being so constructed that a ball (K) running in the ball guide housing will, whenever a specified tilt angle ($a_O$) is exceeded, roll from one ball resting place into another, depending on the direction of the tilt angle, a light transmitter (d) being located in the ball guide housing, and light receivers (P1–P3) being so located in not less than three of the remaining four ball resting places such that each respectively is covered when the ball is located in the ball resting place associated with the respective light receiver, but receives the light from the light transmitter when neither the light transmitter nor the light receiver is covered.

9. Remote control transmitter in accordance with claim 8, characterized in that the light transmitter (D) is located in one of the ball resting places, and three light receivers (P1–P3) in three other ball resting places.

10. Remote control transmitter in accordance with claim 8, characterized in that the ball rolling tracks between the ball resting places are so constructed that for moving the ball (K) out of one ball resting place a different tilt angle must be set to that required for moving the ball into said one ball resting place, so that a ball position once reached is maintained within a specified tilt range.

* * * * *